United States Patent [19]

Blessing et al.

[11] Patent Number: 5,039,078

[45] Date of Patent: Aug. 13, 1991

[54] SEPARATING AND FEEDING GARMENT PARTS

[75] Inventors: Hubert Blessing, Dallas; Gene Croyle, Plano, both of

[73] Assignee: Levi Strauss & Co., San Francisco, Calif.

[21] Appl. No.: 415,903

[22] Filed: Oct. 2, 1989

Related U.S. Application Data

[63] Continuation-in-part of Ser. No. 915,148, Oct. 3, 1986, Pat. No. 4,871,161, which is a continuation-in-part of Ser. No. 649,503, Sep. 11, 1984, Pat. No. 4,688,781.

[51] Int. Cl.[5] ..... B65H 3/22

[52] U.S. Cl. ..... 271/1; 271/18.3; 271/34; 271/104; 271/151; 271/167; 271/168

[58] Field of Search ..... 271/18.3, 34, 150, 151, 271/167, 168, 104, 111, 1

[56] References Cited

U.S. PATENT DOCUMENTS

| | | | |
|---|---|---|---|
| Re. 30,084 | 8/1979 | Morton | 271/10 |
| 868,327 | 10/1907 | Allen | 271/121 |
| 939,182 | 11/1909 | Allen | 271/121 |
| 1,116,992 | 11/1914 | Carleton | 271/129 |
| 2,151,228 | 3/1939 | Pflanze | 271/1 |
| 2,584,730 | 2/1952 | Novick | 271/62 |
| 3,149,835 | 9/1964 | Branscome | 271/62 |
| 3,442,505 | 5/1969 | Szentkuti | 271/1 |
| 3,545,741 | 12/1970 | Porth | 270/58 |
| 3,738,645 | 6/1973 | Gray et al. | 271/26 R |
| 3,908,983 | 9/1975 | Long | 271/35 |
| 3,981,495 | 9/1976 | Bijttebier | 271/18.3 |
| 4,046,369 | 9/1977 | Kluge et al. | 271/3.1 |
| 4,049,260 | 9/1977 | Szymborski | 271/151 |
| 4,089,518 | 5/1978 | Vollrath | 271/167 |
| 4,143,871 | 3/1979 | Blessing | 271/10 |
| 4,157,823 | 6/1979 | Morton | 271/10 |
| 4,283,047 | 8/1981 | Blessing | 271/10 |
| 4,506,876 | 3/1985 | Nishibori | 271/104 |
| 4,542,672 | 9/1985 | Pearl | 83/409 |
| 4,544,149 | 10/1985 | Graef et al. | 271/107 |
| 4,591,140 | 5/1986 | Illig et al. | 271/11 |
| 4,684,120 | 8/1987 | Kamal | 271/168 |
| 4,688,781 | 8/1987 | Blessing | 271/1 |
| 4,750,732 | 6/1988 | Hara | 271/151 |

FOREIGN PATENT DOCUMENTS

| | | | |
|---|---|---|---|
| 998406 | 10/1976 | Canada | 271/129 |
| 413450 | 5/1925 | Fed. Rep. of Germany . | |
| 516768 | 2/1931 | Fed. Rep. of Germany . | |
| 521624 | 3/1931 | Fed. Rep. of Germany | 271/37 |
| 113637 | 9/1981 | Japan | 271/94 |
| 371615 | 4/1932 | United Kingdom | 271/37 |

*Primary Examiner*—Richard A. Schacher
*Attorney, Agent, or Firm*—Virginia S. Medlen

[57] ABSTRACT

Apparatus for the seriatim separation and feeding of garment parts from a shingled stack of the parts to a predetermined destination. Comprising the apparatus is a movable hold down mechanism for engaging the trailing edge of the second part in the stack and a picker head for engaging the leading edge of the first part in the shingled stack and removing it from the stack. Mechanisms are provided for accurately determining the location of the trailing edge of the second part in the stack and moving the hold down mechanism into position to accurately engage the trailing edge of the second part in the stack. Following separation, the separated part is transferred to a second location at which the head is withdrawn from the transferred part.

13 Claims, 5 Drawing Sheets

SEPARATING AND FEEDING GARMENT PARTS

This application is a continuation-in-part of application Ser. No. 06/915,148 filed Oct. 3, 1986, now U.S. Pat. No. 4,871,161, which is a continuation-in-part of application Ser. No. 649,503 filed Sept. 11, 1984 now U.S. Pat. No. 4,688,781.

TECHNICAL FIELD

The field of art to which the invention pertains comprises the art of separating and feeding individual garment parts from a stack for supplying the separated parts to a work station at which manufacturing operations are to be conducted on the part.

BACKGROUND OF THE INVENTION

In the production of garment goods assembled from fabric or other apparel materials, it is customary to cut a number of parts simultaneously from a stack of plural layers or sheets of fabric followed by separation of the fabric layers for further operations. In the manufacture of goods such as shirts and pants, for example, various parts are subjected to preliminary sewing operations such as hemming and/or partial preassembly and then restacked in one form or another and fed to a further operation. The parts are then normally required to be separated from the stack prior to each successive sewing operation.

Separation of fabric parts from a stack of parts of like material can be particularly difficult. A major difficulty encountered in separation occurs when the second or subsequent parts in the stack "follow" the top most part as it is being removed. Because fabric is flexible and often has a texture with a relatively high coefficient of friction, like parts tend to cling together causing the "following" phenomenon whereby when a top part is engaged and pulled from a stack, the second and possibly other parts will cling to the engaged part and be dragged off the stack with it. Reliable separation processes are therefore needed to facilitate the automation of the manufacturing process.

SUMMARY OF THE INVENTION

Disclosed in parent applications Ser. Nos. 15,148 and 649,503, now U.S. Pat. Nos. 4,871,161 and 4,688,781 respectively, which are incorporated herein by reference, is the separation of fabric parts from a stack of like parts which are somewhat staggered so that corresponding edges of adjacent parts are arranged somewhat like roof shingles, hence the term "shingled stack", by which improved separation techniques are possible.

Staggering the edges of parts of a stack which are aligned with each other at the time the parts are cut out may be obtained by various methods. It can for example be obtained by clamping one edge of the stack and rotating the other edge, then clamping the stack adjacent the other edge and releasing the stack at the first point of clamping to permit the stack to remain in the staggered or shingled configuration. Certain manufacturing processes in the fabrication of apparel parts also inherently discharge the parts from a work station into a staggered or shingled stack configuration. In some instances, where for example the topside and underside of the apparel part have different surface textures and different friction coefficients with materials such as corduroy or brushed denim, the parts may be shingled and removed from the stack in pairs instead of individually.

U.S. Pat. No. 4,688,781 disclosed separation of parts from the top of a shingled stack in which "following" of the second and subsequent parts was avoided by applying vacuum to the bottom of the leading edge of the second and subsequent parts. However, this solution occasionally produced another problem, depending on the material being separated, in which the trailing edge of the second part would cling and curl over as the top most part was removed. The '148 application disclosed an improved mechanism which prevented this "curl over" problem by exerting pressure against the trailing edge of the top most part and the remaining parts in the stack, and accelerating the top most part on removal, relying on the "table cloth effect" to retain the second and remaining parts while removing the topmost part from the stack. While these embodiments solved the "following" problem, their solutions limited the type of picker assembly which could be used by requiring rapid acceleration of the picker assembly and by using vacuum as a means for holding down the leading edge of the second part in the stack.

The present invention provides further improvements in separating and feeding parts of relatively flexible garment materials such as fabric parts of various articles of apparel from a shingled stack of such parts, even though the parts may be formed of various types of fabric having a tendency to cling or resist separation from adjacent parts in the stack, without the need for rapid acceleration of the picker assembly or the use of vacuum for holding down the remaining parts in the stack.

In accordance with one embodiment of the present invention there is provided an improved apparatus particularly adapted for separating and transferring individual apparel parts arranged in a staggered or so-called shingled stack of parts. In this embodiment, the parts are stacked such that an edge of the top most part, which may be hemmed or unhemmed, or a portion of a surface of the top most part is engaged by any type of picker assembly connected to a transfer mechanism. At the same time the picker assembly engages the first (top most) part in the shingled stack, a hold down mechanism applies a perpendicular clamping force on the trailing edge of the second part of the stack and the remaining parts in the stack. The hold down mechanism can include rod-like "fingers" which apply a perpendicular frictional force against the top portion of the trailing edge of the second part, or can include needles or other features for penetrating and positively securing the second and remaining parts to prevent "following".

By constructing the hold down mechanism so that the hold down rods or "fingers" can be moved in a controlled fashion in either direction along the axis of travel of the shingled stack of parts, and by using optical and proximity sensors to determine the presence or absence of a part engaged by the picker assembly and whether a single part or more than one party was engaged, the position of the fingers can be automatically adjusted to provide a hold down point on the trailing edge of the second part in the stack to permit the separation of the first part in the stack.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENTS

Figures 1, 1A:
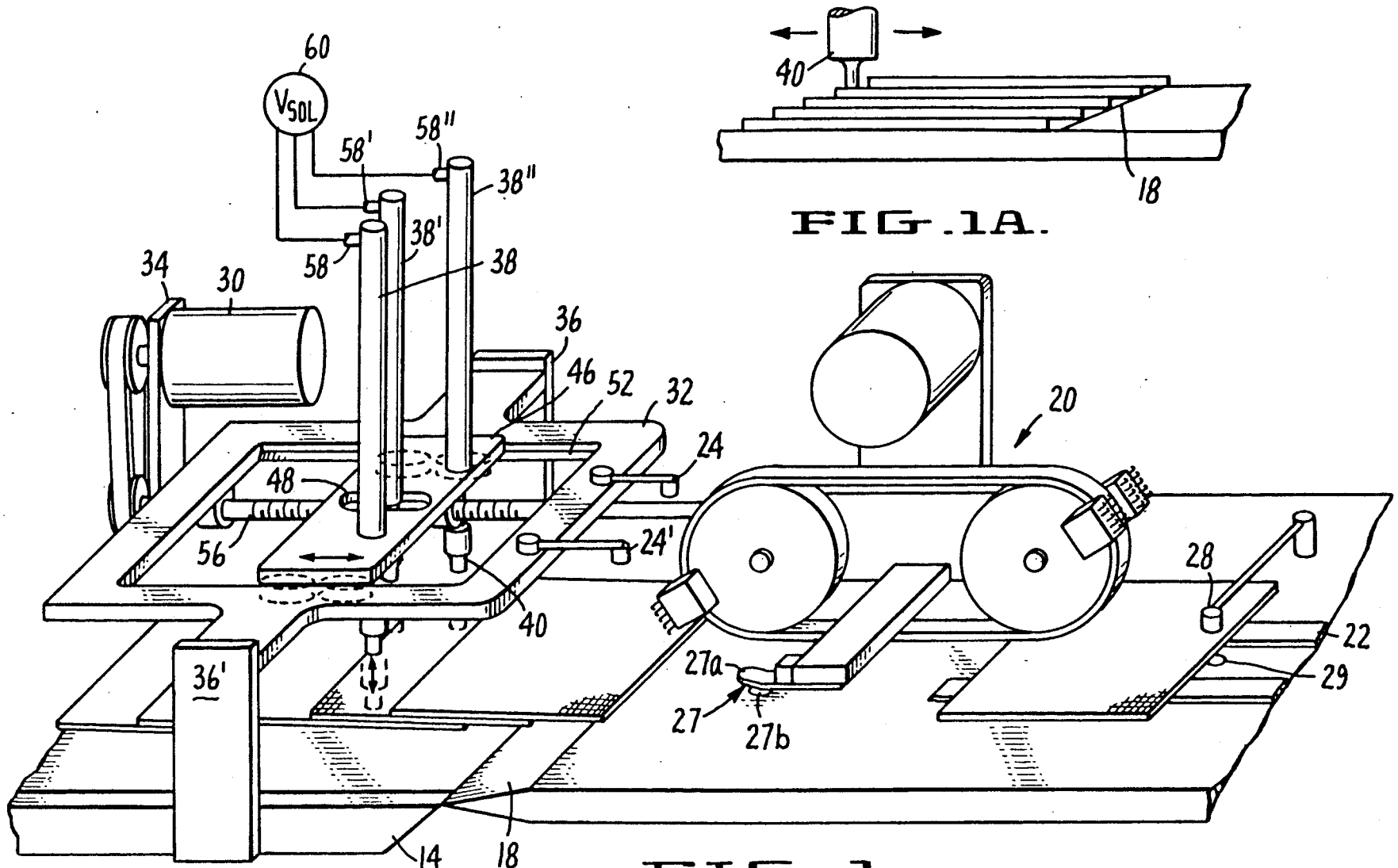
FIG. 1 is a perspective side view of an apparatus of the present invention.
FIG. 1A is a side view of a shingled stack showing a hold down finger engaging the trailing edge of the second part in the stack in the "down" position.

In the description which follows, like parts are marked throughout the specification and drawings with the same reference numerals, respectively. The drawings are not necessarily to scale and certain features may be shown exaggerated in scale or in somewhat schematic form in the interest of clarity and conciseness.

The apparatus of the present invention is particularly adapted for use in conjunction with the automated manufacture of garment articles of apparel such as denim jeans, and for handling certain parts of the garments in the various stages of the manufacturing process. In particular, the embodiments of the apparatus described in detail herein are suitable for separating precut parts of fabric for pocket parts of trousers, which parts may be hemmed along the top edge of the pocket part and stacked in a staggered or shingled configuration. In that arrangement, the parts are oriented relative to each other in the same direction and the corresponding edges are staggered so that an edge or hem of each part is presented to the apparatus for separation of the top part of a stack from the remaining parts in the stack. Those skilled in the art will recognize that the apparatus may be used in conjunction with separating and feeding various other stacks of different sizes and configurations composed of other garment materials and which may include subassemblies thereof. Parts need not necessarily be hemmed although parts having a hemmed edge or other surface which may be positioned interlocked or engaged will handle with particular ease.

Figure 1B:
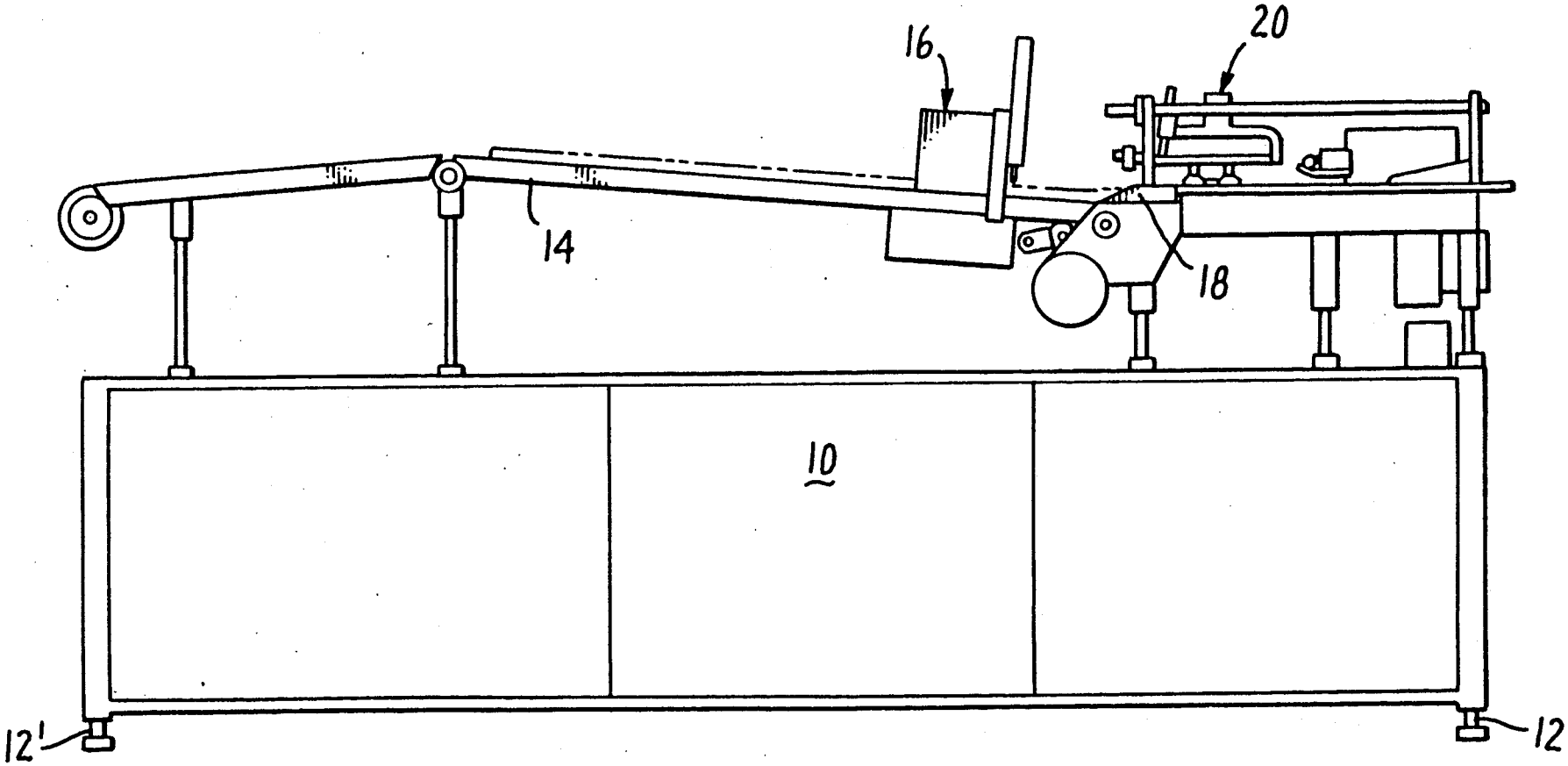
FIG. 1B is a side view of an apparatus of the present invention supported on a table.
Figure 1C:
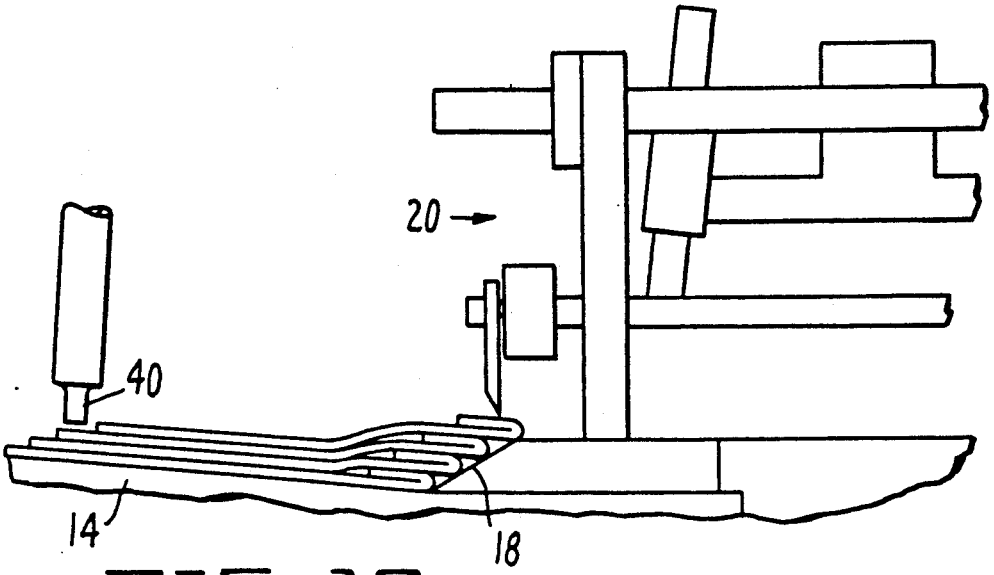
FIG. 1C, 1D and 1E illustrate different picker assemblies which can be used with a hold down apparatus as shown in FIG. 1 and 1B.
Figure 1D:
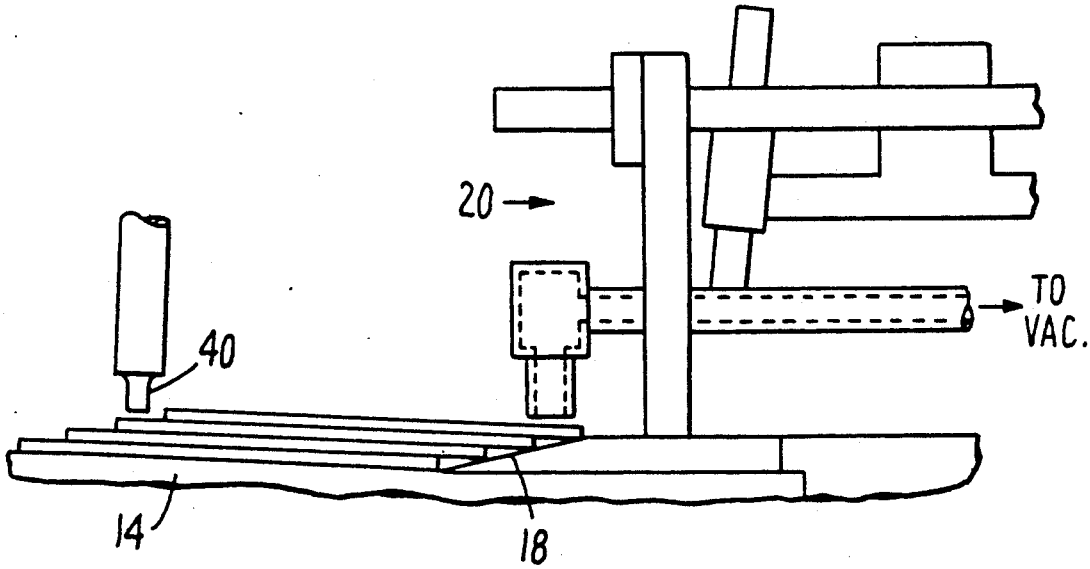
Figure 1E:
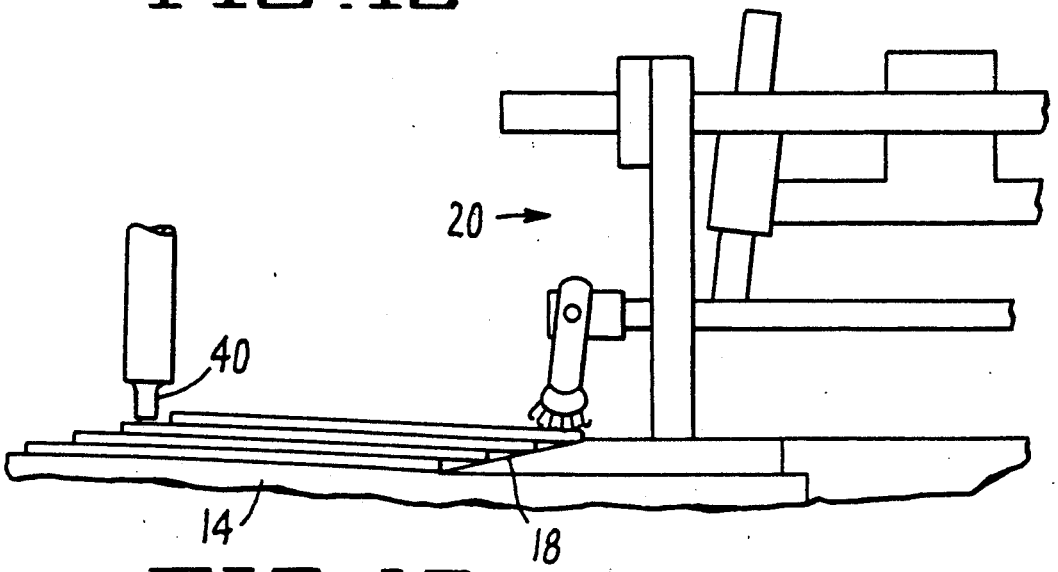

Referring initially to FIGS. 1, 1A and 1B of the drawings, the separation and feed mechanism is supported on a horizontal surface such as table 10 having vertically adjustable legs 12. Feeding conveyor 14 is provided for supporting and advancing a shingled stack as it passes from a source of parts under holddown assembly 16 to ramp 18 where picker assembly 20 can be used to sequentially separate and move each part from the stack to a rear location, for example to transfer conveyor 22. Any suitable picker assembly 20 can be used. For example, as shown in FIGS. 1C through 1E, a knife edge separator, a vacuum separator, and a multiple needle array separator can be connected to a transfer mechanism and used as a picker assembly 20 to remove the top most part in a shingled stack of parts. Ramp 18 defines an angled surface with respect to the plane of table 10. The ramp 18 merges with a substantially horizontal surface which is traversed by picker assembly 20. These surfaces are polished and smooth to enable low friction movement of the garment parts thereover.

As disclosed in detail in U.S. Pat. No. 4,871,161, the angle of conveyor 14 is preferably adjustable to match that of the shingled stack and can be conveniently changed to accommodate different material compositions or other requirements as may become desirable. Further, and also as disclosed in detail in U.S. patent application Ser. No. 915,148 filed Oct. 3, 1986, the conveyor can be used in conjunction with one or more conveyors operating at relatively different transport speeds to change the spacing of the parts in the shingled stack to aid in separation efficiency.

Optical sensors (photocells) 24, 24', and 28 and thickness switch 27 are provided to control and adjust the position of hold down assembly 16 as described more fully below. Thickness switch 27 is a spring biased metal finger **27*a* extending over a proximity switch 27*b* mounted in the support surface in the path of travel of the separated parts during the operation of the picker assembly 20. The distance between the metal finger 27*a* and the proximity switch 27*b* of thickness detector 27 is set to be slightly greater than the thickness of one part. That is, when one part passes between the metal finger 27*a* and the proximity switch 27*b*, the proximity switch continues to sense the presence of the metal finger. However, when two parts pass between the metal finger 27*a* and the proximity switch 27*b*, the metal finger is lifted out of range of the proximity switch and a signal is sent to the microprocessor. During operation of the picker assembly 20, the separated part is pulled under thickness switch 27 by the picker assembly 20. If only one part has been engaged by the picker assembly 20, that part will pass between metal finger 27*b* and the support surface without activating the proximity switch 27*b*. If two parts pass between the metal finger 27*a* and the support surface, the proximity switch 27*b*** is activated. If separation by pairs is not desirable, action can then be taken downstream to remove one of the two parts.

Referring to all the figures, the preferred hold down apparatus 16 comprises a frame 32 having motor mounting bracket 34 and mounting brackets 36, 36' for mounting hold down apparatus 16 in position above conveyor 14. A primary feature of hold down apparatus 16 are the hold down fingers 38, 38' and 38''.

Figure 2:
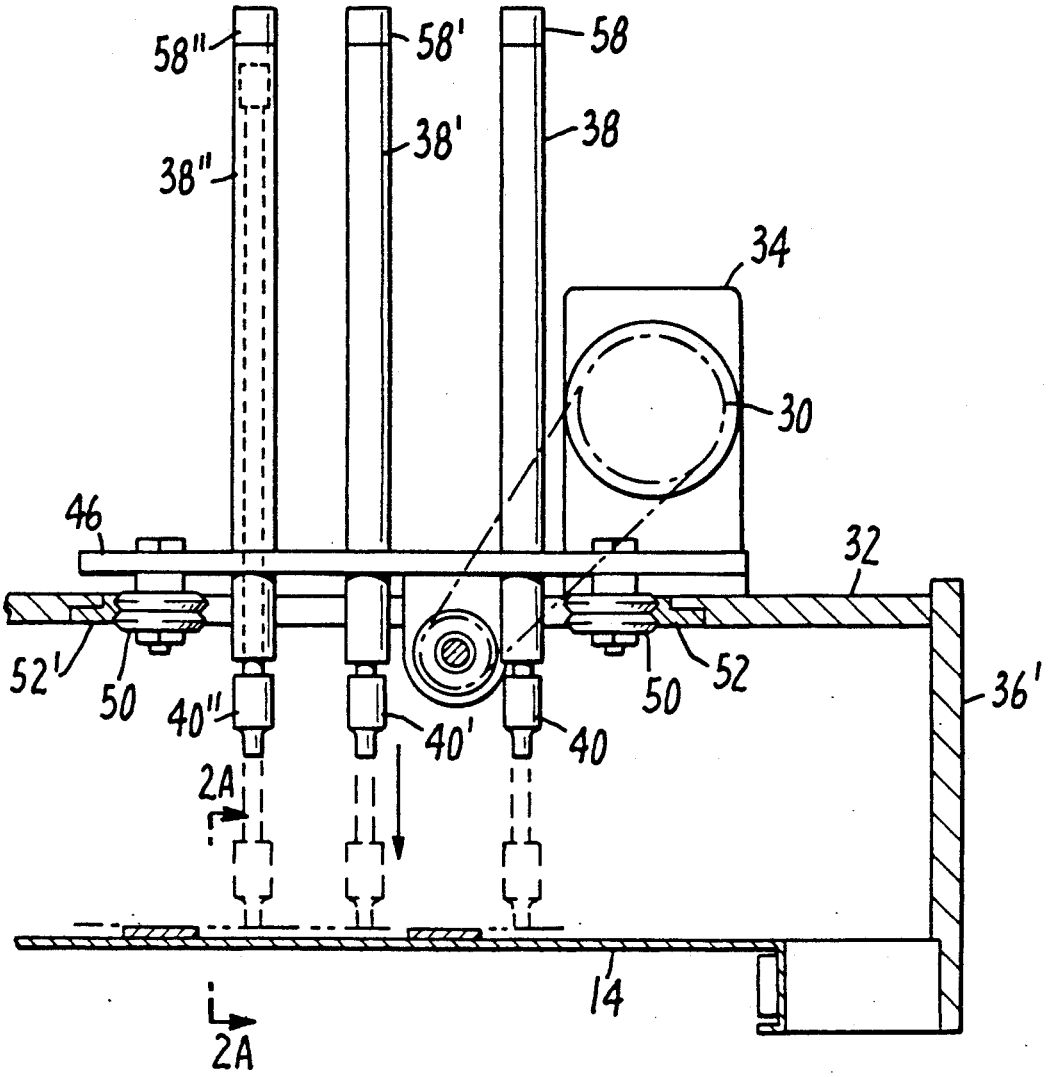
FIG. 2 is a back view of a hold down apparatus of the present invention.

Preferably, there are three hold down fingers 38, 38', 38'', however, depending upon the size and shape of the parts in the shingled stack, separation may be achieved with fewer or more hold down fingers. Hold down fingers 38, 38' and 38'' are operable between a first "up" position as shown in solid lines in FIG. 2 where tip 40 is suspended well above conveyor 14 to allow for unimpeded passage of a shingled stack and a second "down" position as shown in phantom lines in FIG. 2 where tip 40 is adjacent to conveyor 14.

Figures 2A, 2B, 2C:
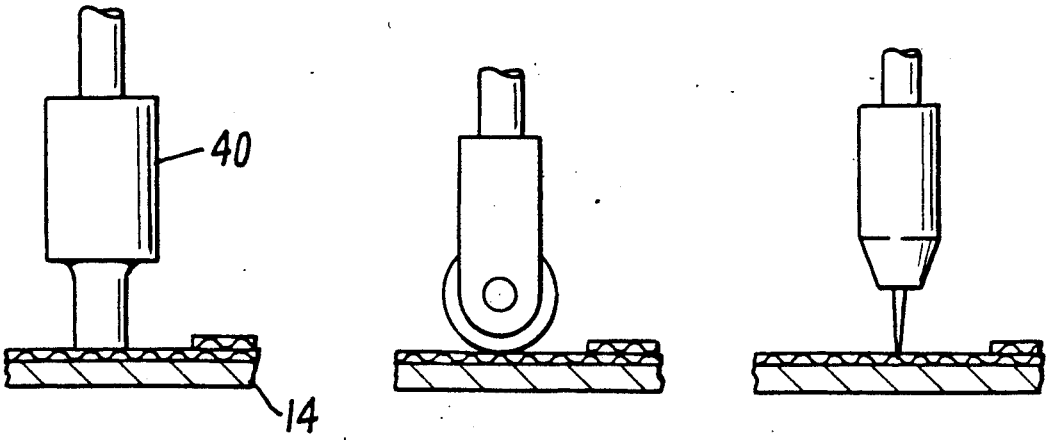
FIG. 2A, 2B and 2C illustrate different tips which can be used with a hold down apparatus as shown in FIG. 2.

Hold down fingers 38, 38' and 38'' are preferably constructed from pneumatic cylinders having pneumatic pistons which move out of the cylinders with an increase in air pressure in the "down" position and which move into the cylinder with a decrease in air pressure in the "up" position. The pneumatic pistons should be adapted to accept tips 40. Tip 40 is preferably a non-penetrating frictional pin-type tip as shown in FIG. 1A and 2A. However, one or more of the tips 40 can be a rollertype tip as shown in FIG. 1 and FIG. 2B or a penetrating needle-type tip as shown in FIG. 2C.

The two outside hold down fingers 38, 38" can be connected through connectors 58, 58" to the same pneumatic line using a "T" connector (not shown). However, if this is done, the air line attaching finger 38 to the "T" connector should preferably be the same size as the air line attaching finger 38" to the "T" connector in order to equalize pressure to the two fingers 38, 38".

Middle hold down finger 38' is preferably attached to a separate pneumatic line. Control of the air pressure to the hold down fingers 38, 38', 38" can be effected through means well known in the art such as the use of conventional solenoid switch 60.

Figure 4:
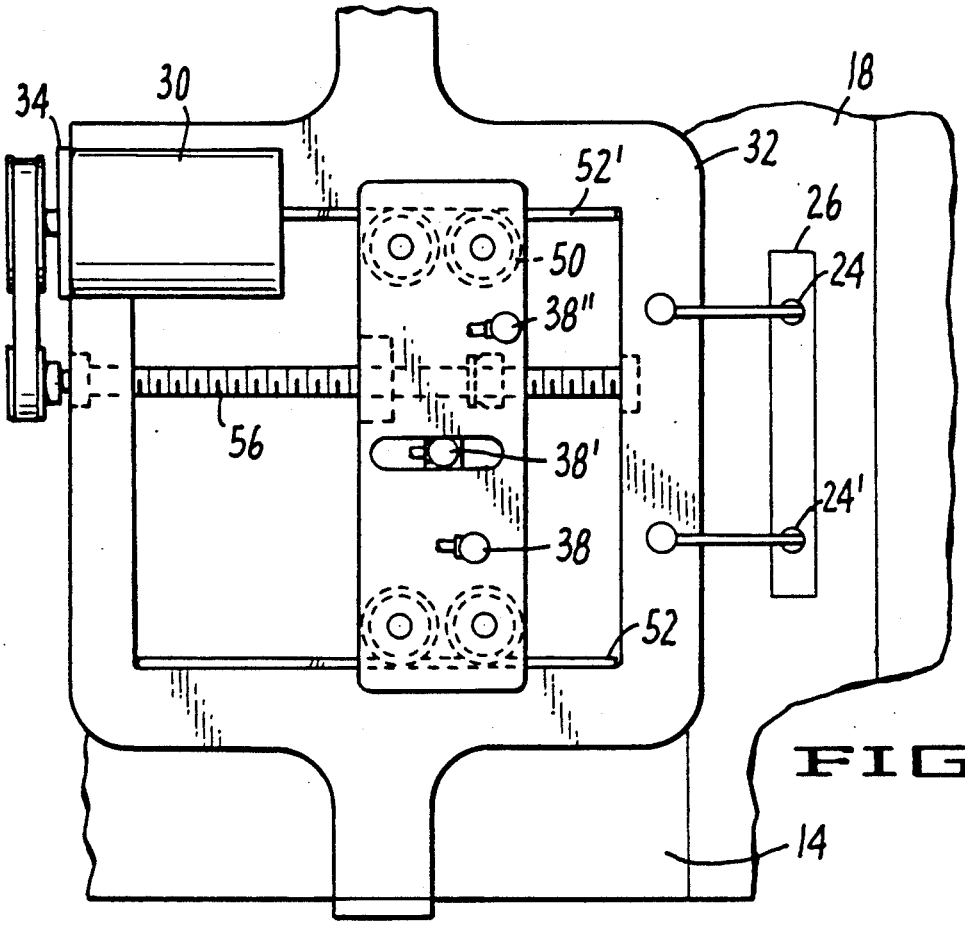
FIG. 4 is a top view of a hold down apparatus of the present invention.
Figure 3:
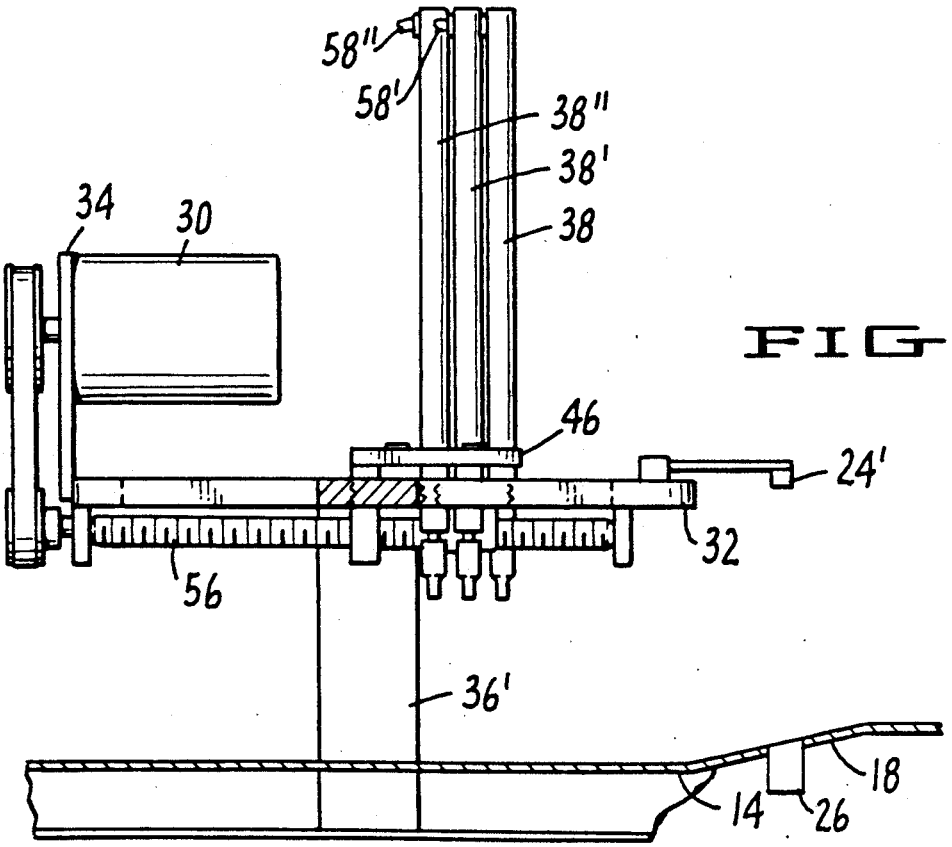
FIG. 3 is a side view of a hold down apparatus of the present invention.

Hold down fingers 38, 38', 38" are attached to carriage plate 46. As shown in FIG. 4, fingers 38, 38" are preferably attached in a fixed position, while finger 38' is movably attached to slot 48 which permits the position of finger 38' to be adjusted along the axis of travel of conveyor 14 within the confines of slot 48. This permits the position of hold down fingers 38, 38', 38" to be adjusted with respect to each other to conform to the shape of the trailing edge of the parts to be separated. It would, of course, be possible to attach all three of fingers 38, 38' and 38" to carriage plate 46 through slots to permit adjustment. It would also be possible to use slots perpendicular to or at an angle to the longitudinal axis of conveyor 14 to permit further adjustment of the spacing between the fingers to accommodate many different sizes and shapes of parts in the shingled stack.

Preferably mounted to the bottom of carriage plate 46 are four wheels 50, 50', 50", 50"' adapted to travel along rails 52, 52'. Rail 52 is mounted on one side of frame 32 parallel to the axis of travel of conveyor 14, and rail 52' is mounted on the opposite side of frame 32, parallel both to the axis of travel of conveyor 14 and to the longitudinal axis of rail 52. Thus, the position of carriage plate 46 in frame 32 can be adjusted along rails 52, 52' towards or away from picker assembly 20 in order to adjust the position of the hold down tips 40 on the shingled stack in the "down" position to insure that the tips 40 will contact only a trailing edge of the second part in the stack. While such adjustment of the position of carriage plate 46 could be achieved manually, for example by an equipment operator, most preferably the adjustment is done automatically.

Automatic adjustment of carriage plate 46 is preferably achieved using a stepper motor 30. Motor 30 is attached to motor mounting bracket 34. Motor 30 drives belt 54 which in turn drives (rotates) shaft 56 about a longitudinal axis which is parallel to the direction of travel of conveyor 14. Shaft 56 is linked to carriage plate 46 for automatically driving carriage plate 46 along rails 52, 52' towards or away from picker assembly 20 when an appropriate signal is received from a microprocessor (not shown). Such movement is preferably done in small increments, most preferably increments of about 1/32 or 1/16 inch, until an optimal position of the tips 40, 40', 40" of fingers 38, 38', 38" on the trailing edge of the second part in the stack is attained.

Finally, hold down assembly 16 also preferably includes light sensors 24, 24' for setting the initial position of the hold down assembly 16 with respect to the leading edge of the first part in the shingled stack. Light sensors 24, 24' detect the presence or absence of the leading edge of the first part in the stack by the presence or absence (interruption) of light from light source 26, which is preferably located on ramp 18. The signals from light sensors 24, 24' are transmitted to a microprocessor (not shown) which controls the movement of conveyor 14. When the top part is removed, light sensors 24, 24' sense the light from light source 26 and the microprocessor signals the conveyor 14 to advance the stack until a leading edge again interrupts the light from light source 26.

The operation of the preferred embodiment as shown in the figures is as follows. As a shingled stack of like parts advances toward the separating and feeding apparatus, information concerning the size and type of parts and the location of the stack is provided to the microprocessor. This information can be provided to the microprocessor, for example, by having an equipment operator key in the information using a keyboard or by tagging each shingled stack with a UPC-type bar coded sticker or card and having an equipment operator scan the sticker or card using a light pen or other conventional bar code scanning apparatus to transmit the information to the microprocessor.

As the shingled stack passes onto conveyor 14 and approaches ramp 18 the microprocessor sends a signal to stepper motor 30 which moves carriage plate 46 to an initial position based upon the information concerning the size and type of parts in the stack.

When the leading edge of the first (top most) part in the stack is detected by light sensors 24, 24', conveyor 14 stops. (The incremental movement of conveyor 14 is described in more detail in U.S. patent application Ser. No. 915,148 which has been incorporated by reference herein). Hold down fingers 38, 38', 38" are placed in the down position (e.g., by supplying air through connectors 58, 58', 58" to pneumatic fingers 38, 38', 38". Control of the air pressure is effected through one or more solenoids 60 whereby the pneumatic pistons of hold down fingers 38, 38', 38" are stroked downwardly from the position shown solid to the position shown in phantom in FIG. 2.

At the same time, picker assembly 20 moves to a first position where it engages the first (top most) part in the shingled stack and moves to a second position rearward where it disengages, for example, at transfer conveyor 22. If all goes well, and carriage plate 46 was properly positioned initially, as picker assembly 20 moves toward the second position, the first part will be pulled under thickness switch 27 and the attached proximity switch will not be activated, and after the first part disengages from picker assembly 20 at the second position, the transmission of light from source 29 to optical detector 28 will be interrupted by the passage of the first part over light source 29 to its rearward destination, indicating the successful removal of the first part.

Upon receiving a signal from optical detectors 24, 24' indicating the absence of a leading edge, the microprocessor will activate the solenoid switches 60 to move hold down fingers 38, 38', 38" to the "up" position, and activate the conveyor 14 to advance the stack until the next leading edge is sensed, at which time the conveyor 14 will stop and the process will be repeated.

However, if the carriage plate 46 was not properly positioned initially, the hold down fingers 38, 38', 38" will be either too far forward or too far back from the optimum hold down position. If the hold down fingers 38, 38', 38" are too far forward, they will hold down the trailing edge of the first part in the stack. When this condition exists, the optical sensor 28 will not detect the passage of a part after the picker assembly has reached the second position. The microcomputer will interpret the failure to detect the passage of the separated part as meaning the carriage plate 46 is too far forward resulting in the trailing edge of the first part being held down, since if the trailing edge of the first part is engaged by hold down fingers 38, 38', 38'' the picker assembly 20 will not be able to separate the first part from the top of the shingled stack. The microcomputer will then signal the stepper motor 30 to move the carriage plate 46 away from the picker assembly 20 by one increment, and the picker assembly 20 will be activated again. This process will be repeated until the optical detector 28 senses the passage of a separated part (the interruption of light from source 29) following the disengagement of the picker assembly 20 at the second position. The conveyor 14 will not be activated to advance the shingled stack until the leading edge of the first part is successfully removed. At that time, light sensors 24, 24' will sense the light from source 26 and the microprocessor will activate the conveyor 14 to advance the stack until the next leading edge is detected (and light from source 26 is again interrupted).

If the carriage plate 46 is set too far back initially, hold down fingers 38, 38', 38'' will engage the stack behind the trailing edge of the second part in the stack and the top two parts can be engaged by the picker assembly 20. If this occurs, the picker assembly 20 will pull two parts between the metal finger 27*a* and the support surface, activating the proximity switch 27*b*. This will send a signal to the microprocessor which will be interpreted as meaning that the carriage plate is set too far back, and the microprocessor will signal the stepping motor 30 to move the carriage plate 46 forward one increment towards the picker assembly. Additionally, the microprocessor can signal an auxiliary device (not shown) downstream from the thickness switch 27 for removing one of the two separated parts if the separation of parts in pairs is not desirable. The process is then repeated until one part only is removed.

Since many changes could be made in the above construction and many apparently many widely different embodiments of this invention could be made without departing from the scope thereof, it is intended that all matter contained in the drawings and specification shall be interpreted as illustrative and not in a limiting sense.

We claim:

1. Apparatus for the seriatim removal of parts of garment material from a shingled stack of the parts and feeding the removed parts to a predetermined destination, said shingled stack having a top part, a second part beneath the top part, and remaining parts beneath the second part, each part in the stack having a top portion, a bottom portion, a leading edge portion and a trailing edge portion, said apparatus comprising:

a support surface for supporting at least a portion of the stack including the parts to be removed from the stack at a predetermined position on said support surface;

hold down means for engaging and holding the trailing edge portion of the second part while the top part is being removed;

a means for engaging the leading edge portion of the top part for removing it from the second and remaining parts in the stack; and, a means for determining the approximate position of the trailing edge portion of the second part and adjusting the hold down means to engage only the trailing edge portion of the second part.

2. Apparatus in accordance with claim 1 including conveyor means for advancing the stack parts from a source of the parts to said support surface in a shingled and stacked relation.

3. Apparatus in accordance with claim 1 in which said hold down means includes a plurality of spaced apart plunger means supported extending substantially upright above and substantially perpendicular to the trailing edge portion of the second part in the vicinity of the support surface and operable between a first position disengaged from the second part and a second position engaging the trailing edge portion of the second part, and a means for actuating said plunger means between said first and second positions.

4. Apparatus for the seriatim removal of parts of garment material from a shingled stack of the parts to a predetermined destination, said shingled stack having a top part, a second part and remaining parts beneath the top part, each part in the stack having a leading edge, a trailing edge, a top surface and a bottom surface and arranged in a shingled fashion in the stack such that the leading edge of each part in the stack extends beyond the leading edge of any underlying part in the stack, said apparatus comprising:

a support surface for supporting at least the top part and some of the remaining parts in the stack as the stack is advanced toward a predetermined position for separation;

an engagement means suspended above the support surface and operable for engaging the leading edge of the top part, moving the top part from the stack to the predetermined destination, disengaging itself from the leading edge of the top part, and returning to the predetermined location for removing the next top part in the stack; and, a hold down means suspended above the support surface and movable for engaging the trailing edge of the second part during separation of the top part from the remaining parts in the stack.

5. The apparatus of claim 4 additionally including a means for determining the approximate location of the trailing edge of the second part and a means for moving the hold down means as necessary for engaging said trailing edge of said second part.

6. The apparatus of claim 5 in which the means for determining the approximate location of the trailing edge of the second part includes an optical detector which determines the location of the leading edge of said first part.

7. The apparatus of claim 6 in which said means for moving the hold down means includes a stepper motor operatively attached to move the hold down means in response to the means for determining the location of the trailing edge of the second part.

8. The apparatus of claim 4 in which said engagement means includes at least one picker head for engaging the leading edge of the top part and an actuating means for moving the picker array into engagement with the top part and for removing the top part from the remaining parts in the stack to the predetermined destination.

9. The apparatus of claim 8 in which said picker head has a plurality of downwardly extending needle points for engaging the leading edge of the top part.

10. The apparatus of claim 8 in which said picker head has a vacuum outlet for engaging the leading edge of the top part using vacuum.

11. The apparatus of claim 8 in which the leading edges of said parts of said shingled stack are hemmed and in which said picker head has a knife-like perpendicular point for engaging the hemmed portion of the leading edge of said top part.

12. The apparatus of claim 4 in which the hold down means includes a plurality of plunger means supported substantially upright and perpendicular to the top surface of the second part at the trailing edge thereof and operable between a first position disengaged from the second part to permit the stack to advance unimpeded to the predetermined position and a second position engaging the trailing edge of the second part.

13. The apparatus of claim 12 in which the hold down means engages the trailing edge of the second part by applying a clamping force thereto.

* * * * *